US011527367B2

(12) United States Patent
Burkett et al.

(10) Patent No.: US 11,527,367 B2
(45) Date of Patent: Dec. 13, 2022

(54) SWITCH WITH PYROTECHNIC ACTUATOR

(71) Applicant: Eaton Intelligent Power Limited, Dublin (IE)

(72) Inventors: Roger Burkett, Swindon (GB); Shailesh Kesarkar, Goa (IN); Varsha Sabale, Pune (IN); Asad Mujawar, Pune (IN)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 17/278,734

(22) PCT Filed: Sep. 20, 2019

(86) PCT No.: PCT/EP2019/075392
§ 371 (c)(1),
(2) Date: Mar. 23, 2021

(87) PCT Pub. No.: WO2020/064567
PCT Pub. Date: Apr. 2, 2020

(65) Prior Publication Data

US 2022/0037094 A1 Feb. 3, 2022

(30) Foreign Application Priority Data

Sep. 24, 2018 (IN) ..... 201811035923
Nov. 20, 2018 (GB) ..... 1818863

(51) Int. Cl.
*H01H 1/20* (2006.01)
*H01H 1/50* (2006.01)
*H01H 39/00* (2006.01)

(52) U.S. Cl.
CPC ..... *H01H 1/20* (2013.01); *H01H 1/504* (2013.01); *H01H 39/004* (2013.01)

(58) Field of Classification Search
CPC ..... H01H 1/20; H01H 1/504; H01H 39/004
(Continued)

(56) References Cited

U.S. PATENT DOCUMENTS 3,793,501 A * 2/1974 Stonestrom ..... H01H 39/00 200/61.08
4,370,531 A * 1/1983 Tobin ..... H01H 33/06 337/6

(Continued)

FOREIGN PATENT DOCUMENTS

WO WO 2007134875 A1 11/2007
WO WO 2018091307 A1 5/2018

*Primary Examiner* — Edwin A. Leon
*Assistant Examiner* — Iman Malakooti
(74) *Attorney, Agent, or Firm* — Leydig, Voit & Mayer, Ltd.

(57) ABSTRACT

A switch includes: an ignition chamber; a pyrotechnic actuator for releasing gas into the ignition chamber upon ignition; a first conductor and a second conductor, the first and second conductors including connection contacts; a third conductor moveable in a direction from a first position towards a second position upon actuation by the pyrotechnic actuator; and a breakable retaining member for retaining the third conductor in the first position prior to actuation by the pyrotechnic actuator, the retaining member breaking upon actuation of the pyrotechnic actuator to allow movement of the third conductor. In the first position, the third conductor is arranged between, and in electrical and physical contact with, the first and second conductors to define a current conduction path. In the second position, the third conductor is electrically and physically separate from the first and second conductors.

17 Claims, 9 Drawing Sheets

(58) Field of Classification Search
USPC ..... 200/16 A
See application file for complete search history.

(56) References Cited

U.S. PATENT DOCUMENTS

| | | | | |
|---|---|---|---|---|
| 6,078,108 | A * | 6/2000 | Froschl | H01R 13/637<br>307/10.7 |
| 2010/0089739 | A1 * | 4/2010 | Filiputti | H01H 50/005<br>200/82 R |
| 2013/0056344 | A1 | 3/2013 | Borg | |

* cited by examiner

SWITCH WITH PYROTECHNIC ACTUATOR

CROSS-REFERENCE TO PRIOR APPLICATIONS

This application is a U.S. National Phase application under 35 U.S.C. § 371 of International Application No. PCT/EP2019/075392, filed on Sep. 20, 2019, and claims benefit to Indian Patent Application No. IN 201811035923, filed on Sep. 24, 2018, and to British Patent Application No. GB 1818863.1, filed on Nov. 20, 2018. The International Application was published in English on Apr. 2, 2020 as WO 2020/064567 under PCT Article 21(2).

FIELD

This relates to opening, or interrupting, a current conduction path. In particular, this relates to a switch including a pyrotechnic actuator for opening a current conduction path, and a method for operating a switch involving ignition of a pyrotechnic actuator.

BACKGROUND

Current conduction paths can be opened by breaking a continuous conductor which defines the current conduction path. One approach is to use a pyrotechnic based switch to break the continuous conductor.

It is desirable to provide an improved apparatus for opening a current conduction path. Such an improved apparatus is desirable for applications which require reliable and rapid opening of a current conduction path, for example, batteries in electric vehicles or electrical overload mechanisms for industrial processes.

SUMMARY

In an embodiment, the present invention provides a switch, comprising: an ignition chamber; a pyrotechnic actuator configured to release gas into the ignition chamber upon ignition; a first conductor and a second conductor, the first and second conductors comprising connection contacts; a third conductor moveable in a direction from a first position towards a second position upon actuation by the pyrotechnic actuator; and a breakable retaining member configured to retain the third conductor in the first position prior to actuation by the pyrotechnic actuator, the retaining member being configured to break upon actuation of the pyrotechnic actuator to allow movement of the third conductor, wherein, in the first position, the third conductor is arranged between, and in electrical and physical contact with, the first and second conductors to define a current conduction path, and wherein, in the second position, the third conductor is electrically and physically separate from the first and second conductors.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following:

FIG. 1.

FIG. 2.

FIG. 3.

DETAILED DESCRIPTION

Figure 1A:
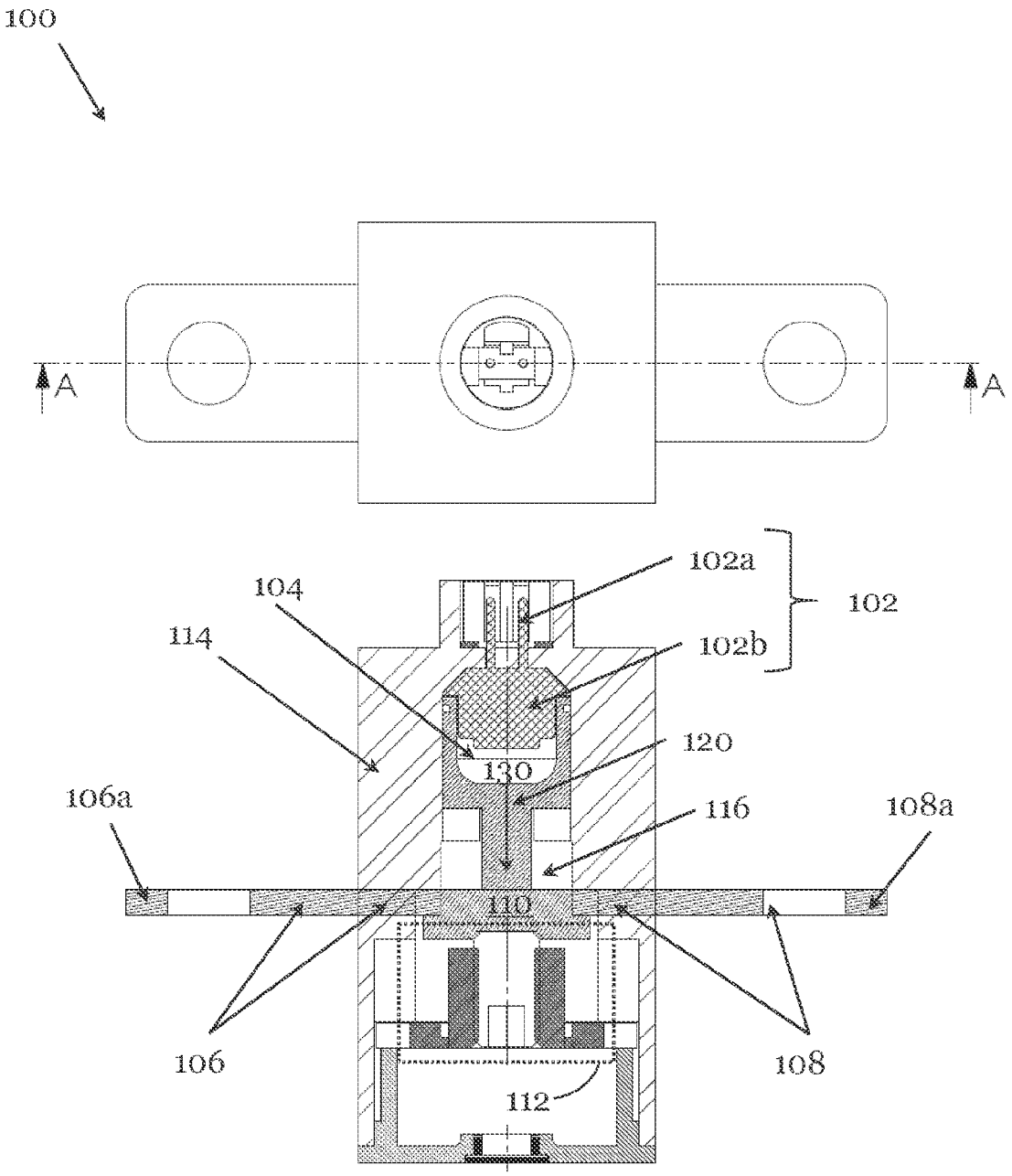
FIG. 1A shows a schematic cross section (A-A) of a switch in accordance with an embodiment of the first aspect, where the switch is in a first, closed, position.

In an embodiment, the present invention provides a switch as described herein, with optional features as described herein. In an embodiment, the present invention provides a method of operating the switch as described herein.

In the following specification, a switch for opening a current conduction path is described. The switch comprises: an ignition chamber; a pyrotechnic actuator arranged to release gas into the ignition chamber upon ignition; a first conductor and a second conductor, the first and second conductors comprising connection contacts; and a third conductor moveable in a direction from a first position towards a second position upon (i.e. in response to) actuation by the pyrotechnic actuator. The switch comprises at least one breakable retaining member arranged to retain the third conductor in the first position prior to (i.e. until) actuation by the pyrotechnic actuator; the retaining member is arranged to break in dependence on actuation of the pyrotechnic actuator to allow movement of the third conductor. In the first position the third conductor is arranged between, and in electrical and physical contact with, the first and second conductors to define a current conduction path; in the second position the third conductor is electrically and physically separate from the first and second conductors.

Previous pyrotechnic based switches (or automatic pyrotechnic based circuit breakers) have relied on a linear arrangement to break a single, or continuous, conductor. For example, a linear displacement of a pyrotechnically actuated piston would cut the conductor into two segments under a wedge type action to interrupt the current. This arrangement may be suitable for some low current applications. However, for higher current applications, the conductor to be broken is typically thicker or wider and therefore high forces are required in order to break the conductor. Such switches therefore typically utilise large pyrotechnic actuators, which leads to costly and bulky switch arrangements. By using three separate conductor pieces, which are joined only with a temporary joint provided by pushing the third conductor against the first and second conductors, significantly smaller forces are required to break the electrical contact of the different conductors and open the current conduction path. This can lead to smaller and cheaper switches suitable for a range of current loads.

In particular, by retaining the third, moveable, conductor in the first position with a breakable retaining member, sufficient forces can be applied to the third conductor to ensure electrical contact is maintained between the first, second and third conductors, whilst facilitating quick and easy opening of the current conduction path once the pyrotechnic actuator is actuated through breaking of breakable retaining member (and hence through breaking of the temporary conductor joints by the subsequent movement of the third conductor). Since there need be no mechanism keeping the third conductor in place other than the breakable retaining member, and no permanent conductor joint (or continuous conductor) needs to be broken, less force is required and smaller pyrotechnic actuators may be used, facilitating the provision of smaller and cheaper switches.

The separation of the different conductors in the manner described herein can also facilitate a reduction in the electric arc (or arc discharge) formed when the different conductors separate from one other. In particular, the movement of the moveable third conductor, relative to the first and second conductors, in response to the actuation (i.e. the linear translation of the third conductor) can rapidly stretch the arc, increasing the arc resistance. An increased arc resistance causes a corresponding increase in arc voltage and a decrease in arc current (since electrical arcs exhibit negative resistance). With the physical separation between the conductors which is achievable with the switch of the first aspect, the arc resistance can be quickly increased with time, and the current correspondingly reduced to such a value that heat formed by the current passing through the air is not sufficient to maintain the arc—the arc is thus extinguished. As such, a more effective interruption of the electrical arc can be provided. A safer and more robust switch may therefore be provided.

Optionally, the switch further comprises arc extinguishing media, which is arranged to be disposed between the first and second conductors when the third conductor is in the second position. The presence of the arc extinguishing media can increase the interruption of the electrical arc, facilitating the provision of a safer switch. In some arrangements, the switch further comprises an arc extinguishing media element coupled to the third conductor; the arc extinguishing media element is arranged to be moved into position between the first and second conductors when the third conductor moves towards the second position. In other arrangements, a store of arc extinguishing media is provided, optionally, within the ignition chamber or provided outside of the ignition chamber but between the pyrotechnic actuator and the third conductor; the arc extinguishing media is arranged to be pushed, by actuation of the pyrotechnic actuator, between the first and second conductors as the third conductor moves from the first position to the second position. Optionally, the arc extinguishing media comprises silica, and may be provided in any suitable form, such as a liquid, powder or other solid form, or a thick, viscous, semi-solid liquid.

Optionally, contact surfaces at which the first conductor contacts the third conductor and at which the second conductor contacts the third conductor extend generally perpendicularly to the direction of movement of the third conductor. This can improve the electrical contact between the conductors. Generally perpendicular as used herein means approximately 90 degrees, optionally up to and including ±45 degrees. Optionally, the retaining member and the pyrotechnic actuator are arranged on opposite sides of the third conductor; this may provide a switch which is easier to assembly. Optionally, the breakable retaining member is arranged to exert a force in a direction substantially opposite to the direction of movement of the third conductor to retain the third conductor. Particularly when the third conductor is provided as described above, this arrangement can apply a more efficient retaining force on the third conductor, improving electrical contact.

Optionally, the pyrotechnic actuator is arranged to release gas into the ignition chamber in a direction substantially parallel to the direction of movement of the third conductor to actuate the third conductor. Such an arrangement may provide for the most efficient transfer of energy between the pyrotechnic actuator to the third conductor. Substantially parallel as used herein means approximately 0 degrees, optionally up to and including ±45 degrees.

Optionally, a piston is arranged between the third conductor and the pyrotechnic actuation, the piston comprising a void which at least partially defines the ignition chamber. The actuation force from the pyrotechnic actuator is transferred to the third conductor through the piston. When the ignition chamber is at least partially defined by the void in the piston, a smaller ignition chamber may be provided (at least initially, it will be understood that the ignition chamber will expand in size as the piston moves). Fewer explosives may therefore be required to produce a desired pressure on the piston, which can provide for a more efficient switch. Alternatively, the third conductor may be directly actuated by the pyrotechnic actuator.

Optionally, the switch further comprises a housing arranged to enclose the third conductor, and at least a portion of each of the first and second conductors, and optionally to enclose the ignition chamber. Optionally, the housing may enclose at least part of the pyrotechnic actuator. The housing is arranged to support the breakable retaining member. This structural support of the breakable retaining member facilitates the efficient application of sufficient force to the third conductor to retain the third conductor in the first position until actuation of the pyrotechnic actuator and breaking of the retaining member. Assembly and manufacture may also be easier and more efficient with such a construction.

Optionally, the retaining member is arranged to shear upon actuation of the pyrotechnic actuator, thereby to allow the movement of the third conductor. The shearing of the retaining member may be provided by form and/or material. Optionally, the retaining member is formed at least partially of plastic; i.e. at least the portion of the breakable retaining member which is arranged to shear may be made of plastic. Plastic can be light weight, cheap, and easily formed, and is therefore well suited as a sacrificial part; cheaper switches suitable for a range of current loads may therefore be provided. Alternatively, the breakable retaining member may be made of any brittle material.

Optionally, the (shearable) retaining member comprises: a supporting element configured to retain the third conductor portion against the first and second conductor portions prior to actuation of the pyrotechnic actuator; and a shearable portion arranged to shear around the supporting element upon actuation of the pyrotechnic actuator. Optionally, the supporting element comprises a threaded portion and a threaded element configured to engage with the threaded portion, the threaded element configured to retain the third conductor portion against the first and second conductor portions prior to actuation of the pyrotechnic actuator. The use of a threaded element can facilitate adjustment of the force provided to the third conductor, which can easily and simply account for any manufacturing tolerances and improve utility of the switch. Moreover, the switch may be quicker and easier to assemble, improving manufacture.

A system is provided comprising a switch as described above and a controller arranged to provide a signal to the pyrotechnic actuator to ignite the pyrotechnic actuator. Such a system may be used in any suitable application where a switch (or automatic circuit breaker, where an activation trigger is provided) is required, such as for overload in industrial applications, for example.

A vehicle is provided comprising a switch as described above. Optionally, the vehicle may further comprise a controller arranged to provide a signal to the pyrotechnic actuator to ignite the pyrotechnic actuator. Optionally, the vehicle is an electric vehicle. The switch may be used, for example, to break a circuit in a battery of the vehicle in case of an accident. This may improve safety.

In the following specification, a method for operating a switch is described. The method is optionally a method for operating the switch of the first aspect. The method comprises: igniting a pyrotechnic actuator; releasing, by the ignition, gas into an ignition chamber; exerting, in dependence on the released gas, pressure on a third, moveable, conductor retained in a first position within the ignition chamber by a breakable retaining member, wherein in the first position, the third conductor is arranged between, and in electrical and physical contact with, first and second conductors to define a current conduction path; breaking the retaining member and moving (or displacing) the third conductor from the first position and towards a second position by (i.e. in response to) the exerted pressure, wherein in the second position the third conductor is electrically and physically separate from the first and second conductors; and opening, by the displacement of the third conductor, the current conduction path of the conductor. Optionally, the third conductor is arranged within the ignition chamber. Optionally, pressure is exerted on the third conductor by way of a piston, the piston comprising a void which at least partially defines the ignition chamber.

It will be understood that any of the features described above with reference to the switch of the first aspect may be provided in any suitable combination. Moreover, any such features may be combined with any features of the method of the second aspect, or vice-versa, as appropriate.

Figure 1B:
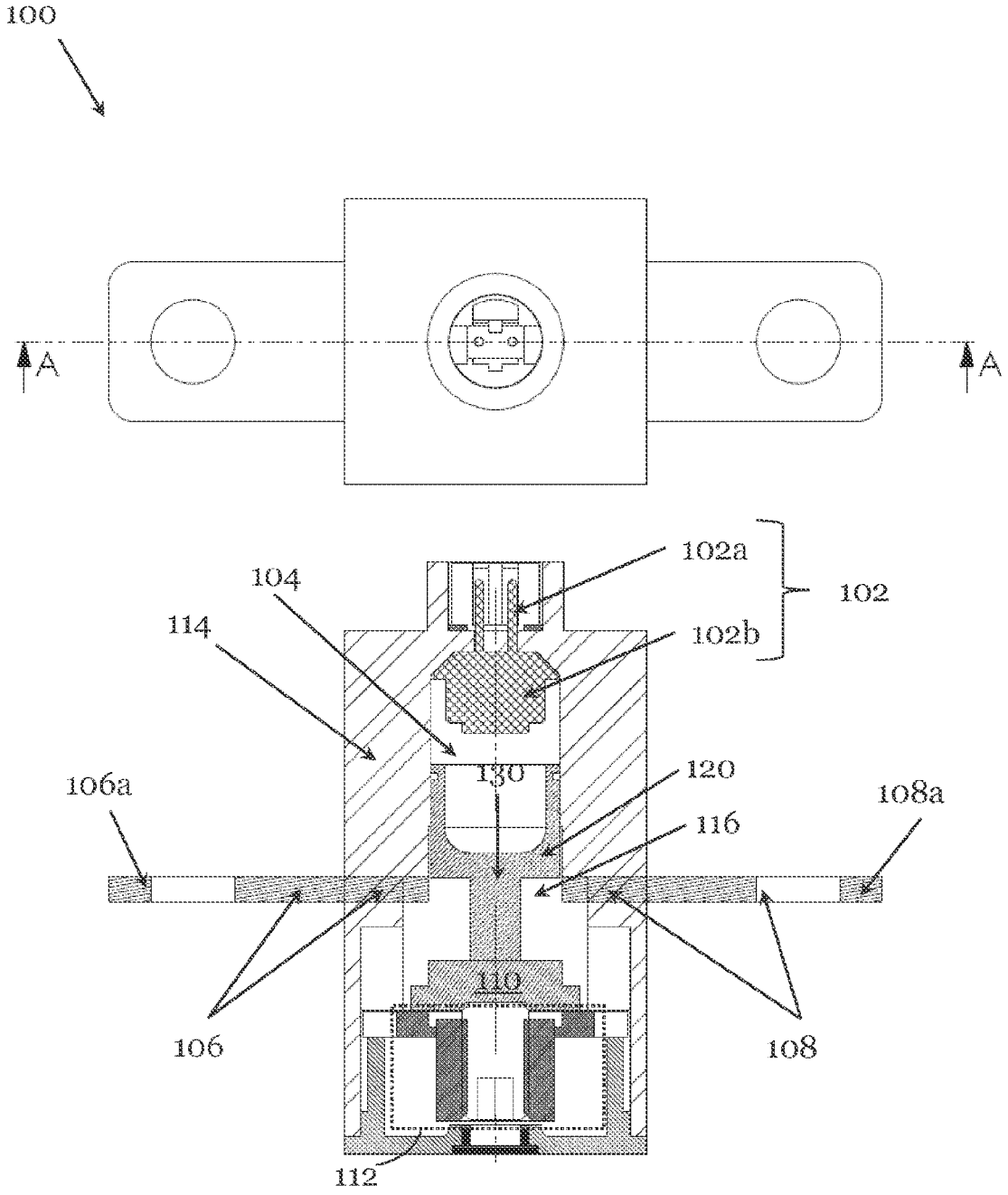
FIG. 1B shows a schematic cross section (A-A) of the switch of FIG. 1A, where the switch is in a second, open, position.
Figure 2A:
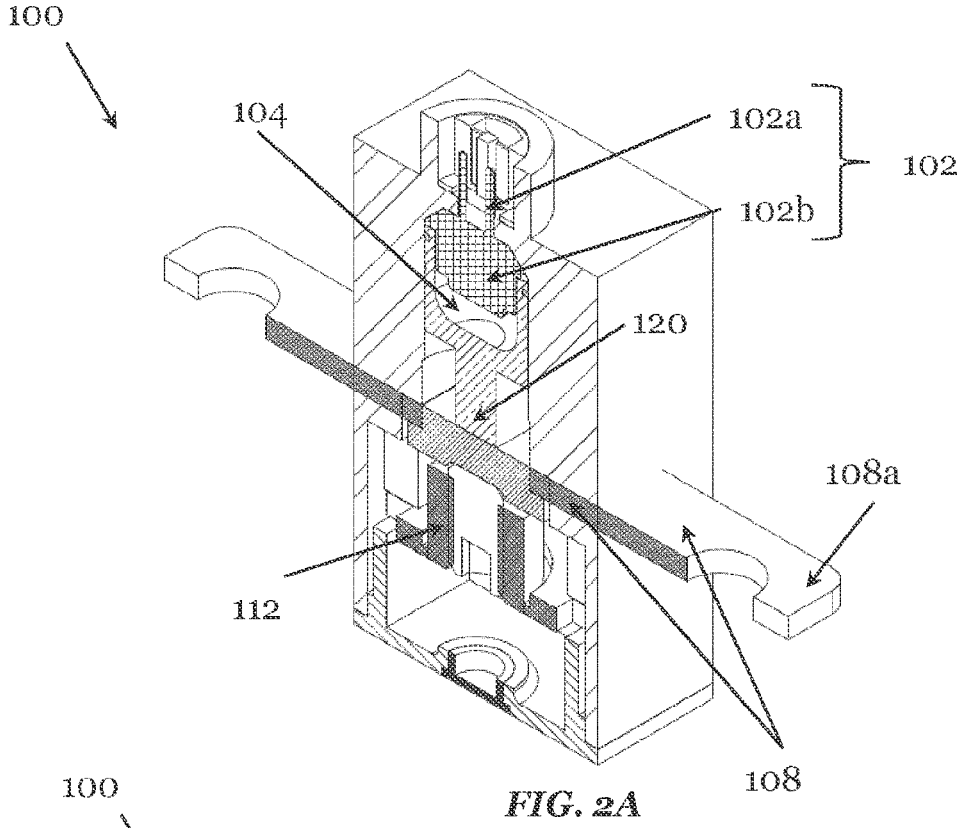
FIG. 2A shows a perspective view of the switch of FIG. 1A.
Figure 2B:
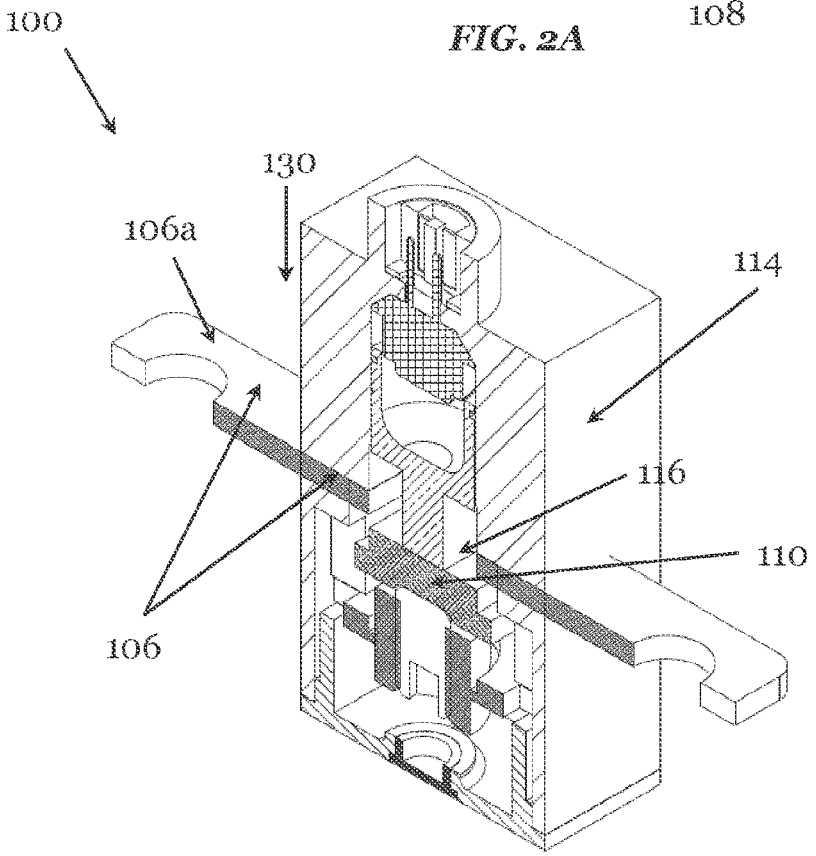
FIG. 2B shows a perspective view of the switch in an intermediary position between closed and open.
Figure 2C:
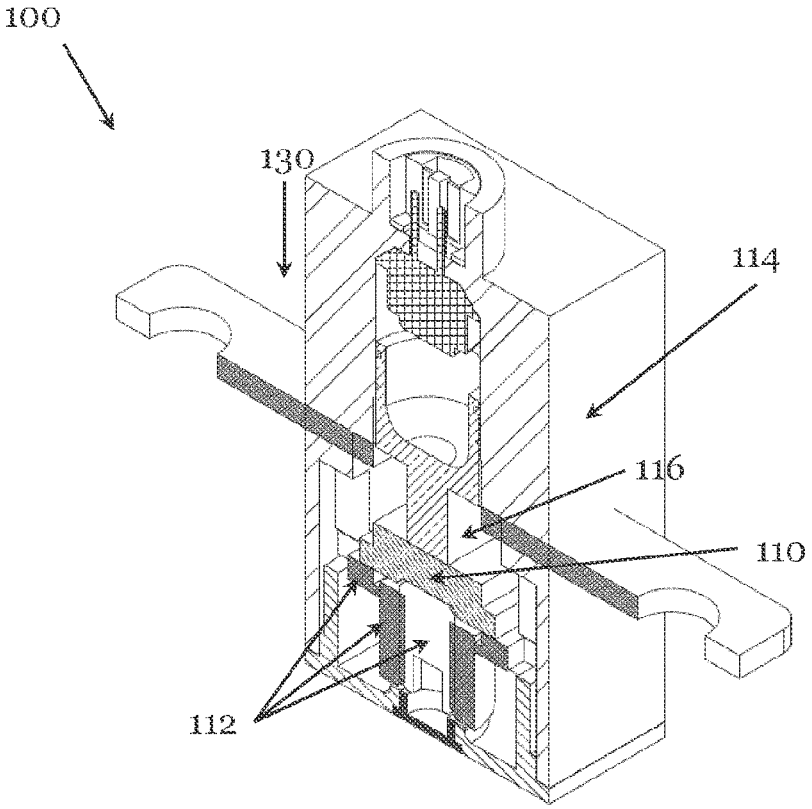
FIG. 2C shows a perspective view of the switch of FIG. 1B.

With reference to FIG. 1 (FIGS. 1A and 1B] and FIG. 2 (FIGS. 2A, 2B and 2C], a switch 100 for opening a current conduction path is described. The current conduction path is defined by a first conductor 106, a second conductor 108 and a third conductor 110. These conductors are separate components, arranged to define a current conduction path by way of a temporary joint between the first 106, second 108 and third 110 conductors.

Switch 100 comprises a housing 114 arranged to enclose the third conductor, and at least a portion of each of the first and second conductors 106, 108. First 106 and second 108 conductors here comprise connection contacts 106*a*, 108*a* provided outside of housing 114 for connection of switch 100 to one or more electrical circuits.

The temporary joint is provided by way of a breakable retaining member 112 (shown within the dotted box of FIG. 1], which acts to retain the third conductor 110 in electrical contact in direct electrical and physical contact with the first and second conductors 106, 108 to define the current conduction path. Contact surfaces at which the first conductor 106 contacts the third conductor 110, and at which the second conductor 108 contacts the third conductor 110, may extend generally parallel to one another in order to facilitate this direct electrical and physical contact.

The breakable retaining member (or retaining member] 112 may be breakable through material and/or form. In the arrangement described with reference to FIGS. 1 and 2, the retaining member 112 is breakable mainly through form, due to the introduction of a mechanical weakness within the retaining member 112. Retaining member 112 may be electrically conductive or electrically insulating; however, the retaining member 112 may be electrically isolated from the third conductor 110 in order to maintain good electrical contact between the first 106, second 108 and third 110 conductors. At least one breakable retaining member 112 may be provided; for example there may be one retaining member, or a plurality of retaining members (two, three, four, or more], as required.

The retaining member 112 retains the third conductor 110 by exerting, or applying, a force in a direction substantially opposite to a direction of movement of the third conductor 110 when the switch is in operation; the reaction force between the retaining member 112 and the portions of the switch housing 114 which support the retaining member acts to resist motion of the third conductor until an actuating force greater than the force supplied by the retaining member 112 is applied. In particular, the retaining member 112 is retained in a fixed position by the housing 114, i.e. is rigidly fixed or secured to the housing; in this way, the third conductor 110 may be retained in the first, closed, position by the retaining member 112, and can therefore be subjected to relatively large vibrations from the environment in which it is deployed without the switch opening (provided the vibrations are not so large as to break the breakable retaining member 112]. This can improve the resilience and utility of the switch 100.

An actuating force is here provided by a pyrotechnic actuator 102, arranged to release gas into an ignition chamber 104 upon ignition. The pyrotechnic actuator 102 comprises connector pins 102*a* and an igniter 102*b*. The connector pins 102*a* activate a charge inside the igniters 102*b* upon receipt of an ignition signal. The pyrotechnic actuator 102 is arranged to, upon activation or ignition of the charge, expel gas into the ignition chamber 104. In this arrangement, the switch comprises a piston 120, which piston comprises a void that defines the ignition chamber. However, it will be understood that the piston may not be provided within the switch, and the ignition chamber may be otherwise defined (for example, it may be defined by a void provided within the housing).

The high-pressure gases which are expelled into the ignition chamber 104 produces an actuating force which acts on the third conductor 110 to cause the third conductor to move from a first position (shown in FIGS. 1A and 2A) towards a second position (shown in FIGS. 1B and 2C) in a direction of movement 130. An intermediate position is shown in FIG. 2B. The pyrotechnic actuator is arranged to release gas into the ignition chamber in a direction substantially parallel to the direction of movement 130 of the third conductor to actuate the third conductor. In this arrangement the force acts on the third conductor 110 via the piston 120, but it will be understood that the force may act on the third conductor 110 directly, or via any other suitable component provided between the pyrotechnic actuator 102 and the third conductor 110. When the third conductor is in the first position the switch is closed, and when it is in the second position the switch is open. In the second, open position, the third conductor is electrically separate from the first and second conductors such that no current can flow through the current conduction path.

Breaking of the temporary joint between the first, second and third conductors, and the subsequent opening of the current path, can lead to formation of an arc between the ends of the third conductor 110 and respective ends of the first and second conductors 106, 108. This phenomenon can occur whenever conductors physically separate from one another. The linear displacement of the third conductor relative to the first and second conductors can facilitate a reduction in this electric arc (or arc discharge) by rapidly stretching the arc, thereby increasing the arc resistance. An increased arc resistance causes a corresponding increase in arc voltage and a decrease in arc current (since electrical arcs exhibit negative resistance). The speed of displacement which occurs, due to the dynamic nature of the force applied by the pyrotechnic actuator and the fact that the conductors do not need to be physically broken in any way, can act to increase the physical separation of the respective conductors quicker than with previous linear approaches, leading to more effective interruption of the electrical arc. A safer and more robust switch may there be provided.

Arc interruption or extinguishing can be further improved through the use of arc extinguishing media. In this arrangement, a store of arc extinguishing media 116 can be arranged in the void around the piston 120, as illustrated in FIG. 1A. As the third conductor is displaced upon (i.e. in response to) actuation of the pyrotechnic actuator 102, the media 116 is correspondingly displaced to fill the gap vacated by the third conductor 110; such displacement may be by the high pressure gases emitted by the pyrotechnic actuator 102 or may be by piston 120, when the piston is provided within the switch. Alternatively, in other groups of embodiments, an arc extinguishing media element 116 may be provided which is coupled to third conductor 110 and arranged to be moved into the gap vacated by the third conductor 110 as the third conductor moves. It will be understood that the arc extinguishing media can be provided in any other suitable arrangement to facilitate interruption or extinguishing of the electric arc. In this group of embodiments, the arc extinguishing media 116 comprises silica. The silica media can be provided in any suitable form, for example as a liquid, powder or other solid, or as a thick, viscous, semi-solid liquid. However, it will be understood that the arc extinguishing media 116 can comprise silica in any suitable form. Alternatively, any other suitable arc extinguishing media may be used.

Figure 3A:
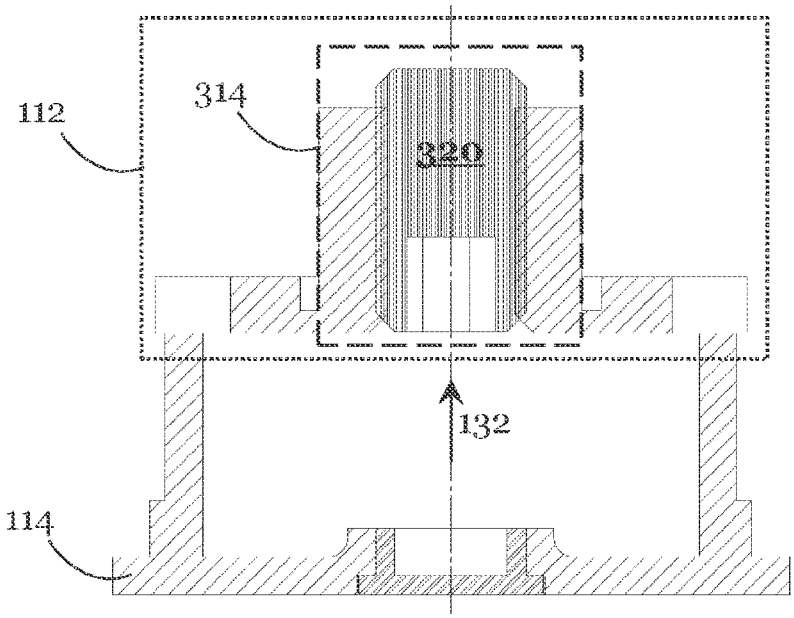
FIG. 3A illustrates elements of a breakable retaining member in accordance with an embodiment of the first aspect.
Figure 3B:
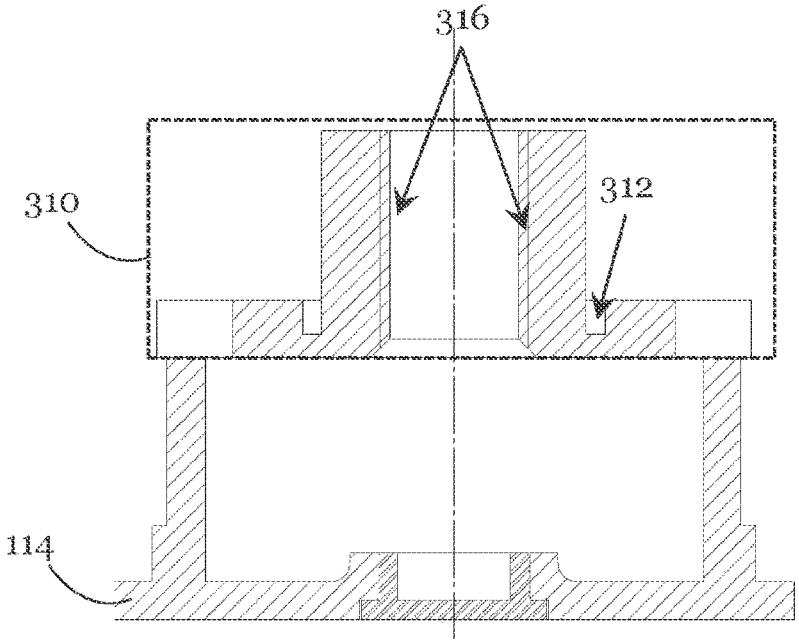
FIG. 3B illustrates the breakable retaining member of FIG. 1A without a threaded element.

With reference to FIG. 3 (FIGS. 3A and 3B), an example breakable retaining member (or retaining member) 112 is described. Retaining member 112 (shown within the dotted box) is supported by the housing 114, i.e. is rigidly held in a fixed position within the switch 100 by the housing 114 prior to actuation of the pyrotechnic actuator 102. The retaining member 112 is arranged to exert a force on third conductor 110 in a direction 132, which direction is substantially opposite to the direction of movement 130 of the third conductor 110, to retain the third conductor in physical and electrical contact with the first and second conductors 108, 106. Substantially parallel as used herein means approximately 0 degrees, optionally up to and including ±45 degrees.

The retaining member 112 of this group of embodiments comprises a 'shear insert' 310 (shown within the small-dash box). The shear insert 310 is a sacrificial part, inserted within and supported by the housing 114, and arranged to shear in response to an actuation force from the pyrotechnic actuator 102. The shearing of the shear insert 310 can arise from one or more mechanical weaknesses within the shear insert 310, for example arising from a geometry of the component, and/or as a result of the material choice.

The shear insert 310 described herein comprises a shearable portion 312 arranged around a supporting element 314 (shown within the large-dash box). The shearable portion 312 comprises a recess, which introduces a mechanical weakness into the shear insert 310 due to the reduction in material thickness. The shear insert is also formed at least partially of plastic to aid shearing. Moreover, plastic is light weight and cheap, facilitating the provision of a lighter and cheaper switch. However, any suitable material and/or structure for the retaining member 112 may be used to provide a component capable of exerting sufficient force to retain the third conductor 110 in the first position until actuation of the pyrotechnic actuator 102, but which is also able to easily shear under the actuation force which results from the high pressure gases generated by the actuator 102. For example, any brittle material could be used to form the shearable portion 312 of the breakable retaining member 112.

The supporting element 314 is arranged to retain the third conductor 110 by applying a force to the third conductor 110, optionally in the direction 132. In this group of embodiments, the supporting element 314 comprises a threaded portion 316 of the shear insert, which threaded portion is arranged to receive a threaded element. The supporting element also comprises a threaded element 320 arranged to engage with the threaded portion 316. Threaded element 320 in this example is a grub screw, but any other suitable threaded element may be used, for example, a bolt or other screw.

The use of a threaded portion 316 and a threaded element 320 can facilitate the provision of an adjustable force to the third conductor 110, which can help to ensure good contact between the third conductor 110 and the first and second conductors 108, 106. This may improve the utility of the switch 100. However, a solid, non-adjustable, supporting element 314 may instead be provided in some embodiments. In other embodiments, the supporting element may be formed of a resilient element (resilient through structure and form and/or though material), which applies a spring-like force to retain the third conductor 110 (which force is in response to the compression of the resilient element between the portion of the housing 114 which supports the breakable retaining member 112 and the third conductor 110 with which it is in contact). For example, a resilient element such as a spring or a rubber protrusion may be used.

It will be understood that regardless of the material used to provide the breakable retaining member 112, or the form or structure of any components of the breakable retaining member, the retaining member 112 may be electrically isolated from the third conductor 110 in order to provide a good conduction path between the first, second and third conductors. Electrical isolation, i.e. insulation, may be provided by an insulating breakable retaining member, or by the use of an insulating layer or section between the breakable retaining member 112 and the third conductor 110. Optionally, the switch 100 comprises an insulating layer disposed between the breakable retaining member 112 and the third conductor 110. Optionally, the breakable retaining member is insulating; for example, the supporting element 314 may be insulating. Optionally, in some groups of embodiments, the threaded element 320 in contact with the third conductor 110 may be insulating; for example the threaded element may be formed of plastic.

Figure 4:
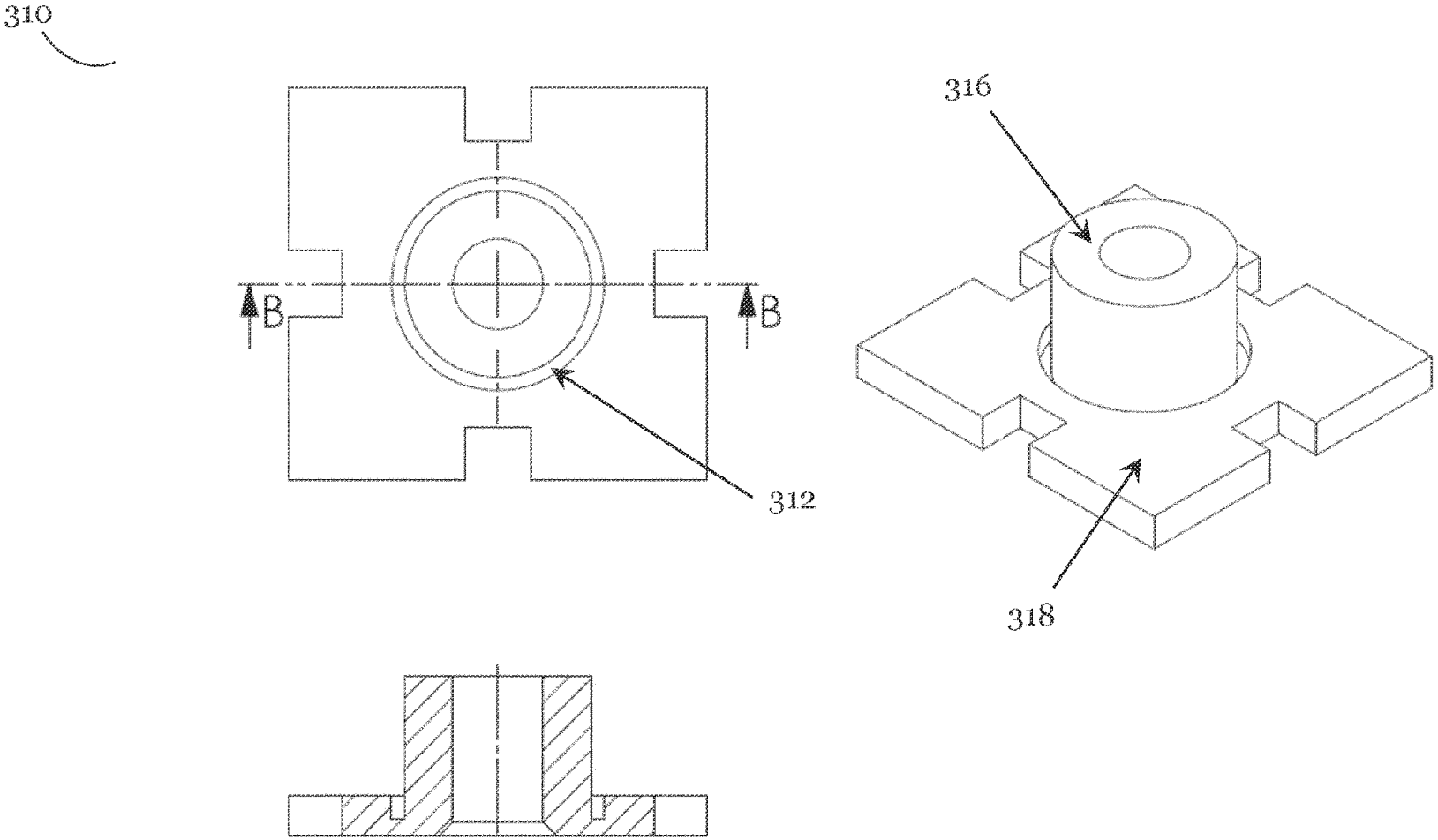
FIG. 4 illustrates a plan view (top left), a schematic cross section (B-B) (bottom left) and a perspective view (right) of a shearable portion of the breakable retaining member of FIG. 3.

With reference to FIG. 4, the shear insert 310 of the breakable retaining member 112 is described in more detail. The shear insert comprises the threaded portion 316, the shearable portion 312 around the threaded portion, and a plate 318. The shearable portion 312 is provided by way of a recess in plate 318. Plate 318 is arranged to be rigidly supported by the housing in order to provide the necessary reaction force on the shear insert for the breakable retaining member 112 to apply sufficient force to retain the third conductor 110 in physical and electrical contact with the first 106 and third 108 conductors.

Figure 5:
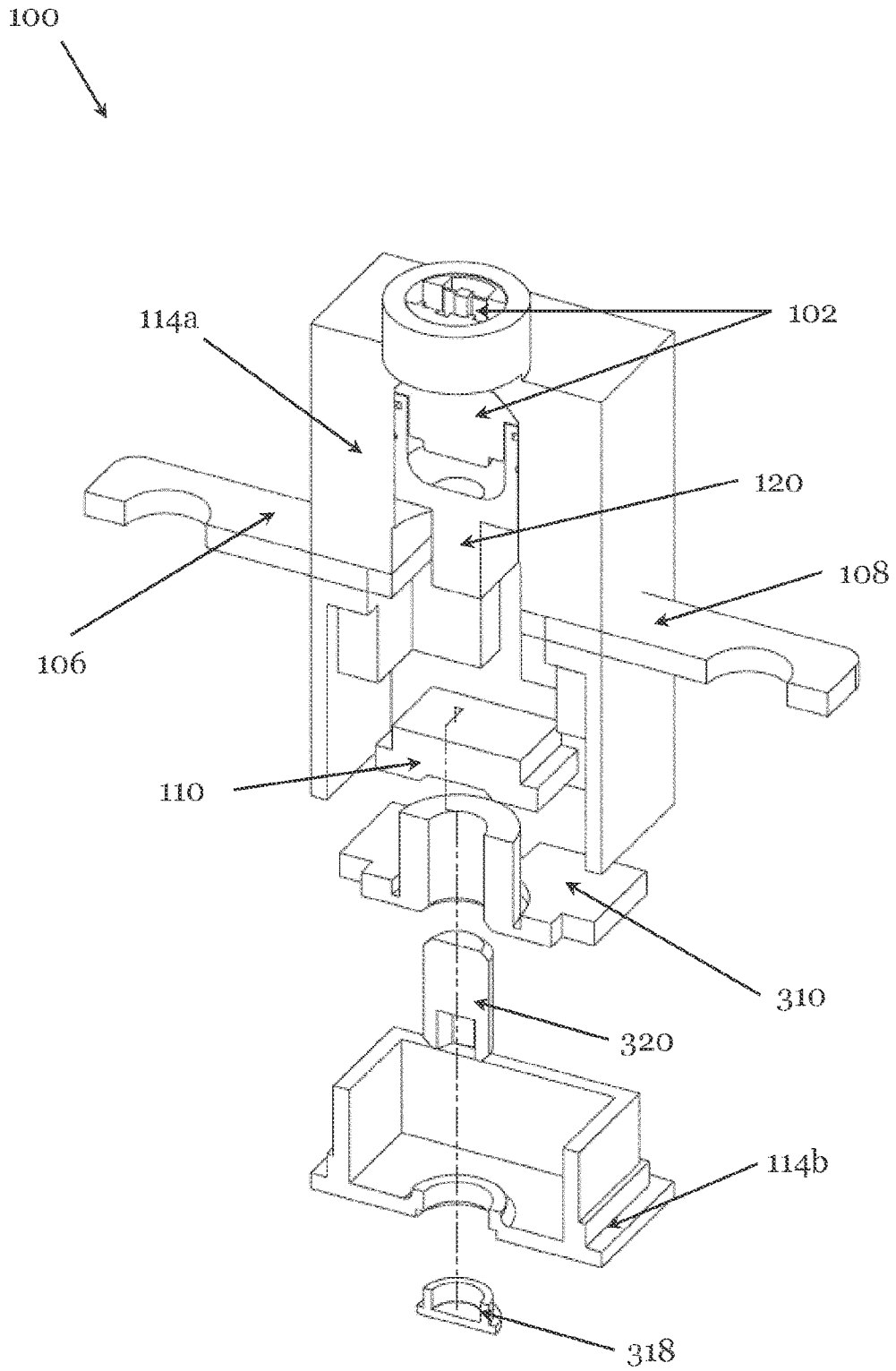
FIG. 5 illustrates an exploded, perspective, view of the switch of FIG. 1A.

With reference to FIG. 5, the assembly and manufacture of switch 100 of the above-described group of embodiments is described.

The first and second conductors 106, 108 are insert moulded into portion 114*a* of housing 114 (the conductors 106, 108 are placed in a mould and then plastic is poured into the mould to create the housing portion 114*a*). The pyrotechnic actuator 102 is placed into the housing portion 114*a* and the piston 120 added. Piston 120 is arranged to fit against the housing portion 114*a* and the sides of the pyrotechnic actuator in order that a substantially sealed ignition chamber is provided by the void in piston 120.

Optionally, arc extinguishing media may be placed into the hollow around the piston. The third conductor 110 is then added, and then the shear insert. These components are inserted from the bottom of housing portion 114*a*. The third conductor is held in position against the first and second conductors by the threaded element 320, which engages with the threaded portion of the shear insert. The force applied can be adjusted by adjusting the threaded element 320 at this stage of manufacture.

Alternatively, portion 114*b* of the housing 114 can be applied before the threaded element is adjusted. Housing portion 114*b* can be welded to the housing portion 114*a*, optionally with ultra-sonic welding, or may be fixed to housing portion 114*a* in any suitable manner. After joining, the plate of the shear insert 310 is then rigidly supported in position between the two housing portions 114*a*, 114*b*. The threaded element 320 can be adjusted through the hole in the base of the housing portion 114*b*. For example, when the threaded element is a grub screw, an Allen, or hex, key can be used to adjust the threaded element 320. After adjustment, cap 318 can be provided to close the hole in housing portion 114*b* to prevent leakage of any arc extinguishing media during use.

Figure 6:
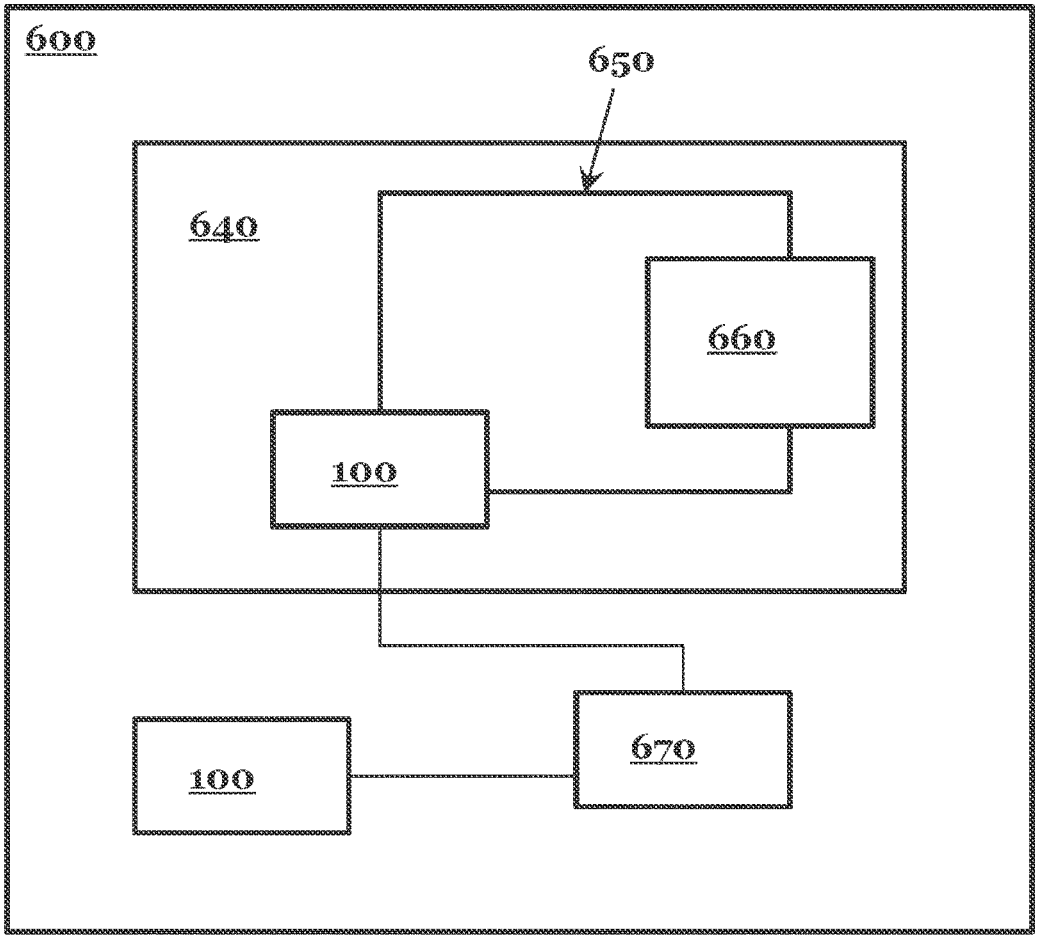
FIG. 6 illustrates a vehicle comprising the switch of the first aspect.

With reference to FIG. 6, a powertrain 640 comprising switch 100 is described. In particular, powertrain 640 can be a powertrain for a vehicle 600. In regard to a vehicle (e.g. a motor vehicle, a ship or boat, or a plane, etc.), a powertrain encompasses the main components that generate power and deliver it to the road surface, water, or air. This includes the engine, transmission, drive shafts, and the drive wheels (or other drive mechanism, such as a propeller). In an electric or hybrid vehicle, the powertrain 600 also includes battery 660 and an electric motor, for example. Switch 100 may be connected, via the connection contacts 106*a*, 108*a* of the first and second conductors, to an electrical circuit 650 within vehicle 600, which electrical circuit may optionally include the battery 660. Alternatively, vehicle 600, which may be an electrical vehicle, can comprise switch 100 in the absence of powertrain 640, as illustrated in FIG. 6.

An ignition signal may be provided to connector pins 102*a* of the pyrotechnical actuator 102 from a remote controller, or a remote power distribution unit, 670 within the vehicle 600. Such an ignition signal may be issued in response to an external event. For example, when the switch 100 is connected to a battery 660 installed in the vehicle 600, an ignition signal may be sent to the pyrotechnic actuator 102 in response to a collision of the vehicle; activation of the charge inside the igniter 102*b* can cause the third conductor 110 to be separated from the first and second conductors in order to open the electrical circuit 650 and prevent the flow of current through the battery 660. Such an arrangement can improve safety in the event of a collision. Alternatively, switch 100 and remote controller 670 can be deployed in any other application where such breaking of a circuit is required.

Figure 7:
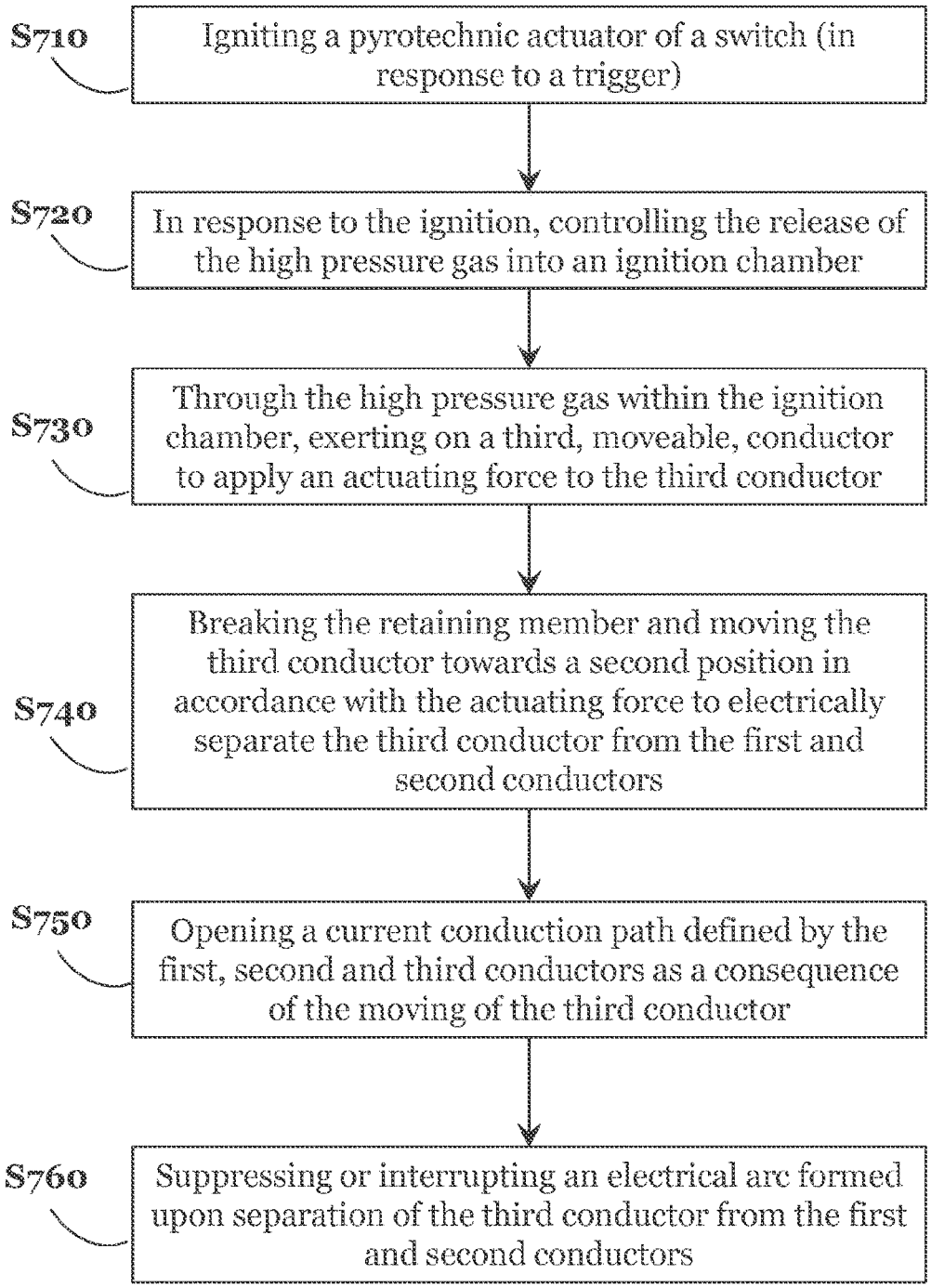
FIG. 7 illustrates a method in accordance with the second aspect.

With reference to FIG. 7, a method 700 for opening a current conduction path using a switch 100 (for example, the switch 100 of the first aspect) is described.

At step 710, the method comprises igniting a pyrotechnic actuator, optionally in response to a collision or other external event triggering an ignition signal which is received by the pyrotechnic actuator. Any other trigger can be used for ignition of the pyrotechnic actuator. Upon ignition of the pyrotechnic actuator, at step 720, high-pressure gas is released into the ignition chamber. This released gas exerts a pressure (either directly or indirectly) on a third, moveable, conductor 110 at step 730, which conductor is arranged and retained in a first position by a breakable retaining member 112. Optionally, the third conductor is arranged within the ignition chamber. Optionally, pressure is exerted by way of a piston, the piston comprising a void which at least partially defines the ignition chamber. In the first position, the third conductor 110 is arranged between, and in (direct or indirect) electrical contact with, first 106 and second 108 conductors to define a current conduction path.

Optionally, in this example, piston 120 is accelerated downwards due to the high pressure gases and, as the piston moves downwards, the third conductor 110 is moved in direction 130.

Movement of the third conductor in turn pushes on support element 314 of retaining member 112 and causes shearing of a shearable portion 312 of the breakable retaining member, thereby breaking the breakable retaining member 112.

At step 740, the breakable retaining member is broken (optionally sheared), by the actuating force and the third conductor is correspondingly moved, i.e. displaced, from the first position and towards a second position. In the second position, the third conductor 110 is electrically separate from the first and second conductors 106, 108; in other words, switch 100 is open. Breaking of the retaining member at step 740 in response to the pressure exerted at step 730, and the corresponding displacement or movement of the third conductor, therefore causes opening of the current conduction path (step 750).

Optionally, at step 760, an electrical arc formed upon separation of the third conductor from the first and second conductors is suppressed, or interrupted. This interruption may be achieved solely by the relative movement of the third conductor, which lengthens the arc, or by the release of arc extinguishing media, for example, a media comprising silica, which can act to cool (and thus interrupt) the electrical arc.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. A switch, comprising:

an ignition chamber;

a pyrotechnic actuator configured to release gas into the ignition chamber upon ignition;

a first conductor and a second conductor, the first and second conductors comprising connection contacts;

a third conductor moveable in a direction from a first position towards a second position upon actuation by the pyrotechnic actuator; and a breakable retaining member configured to retain the third conductor in the first position prior to actuation by the pyrotechnic actuator, the retaining member being configured to break upon actuation of the pyrotechnic actuator to allow movement of the third conductor, wherein, in the first position, the third conductor is arranged between, and in electrical and physical contact with, the first and second conductors to define a current conduction path, wherein, in the second position, the third conductor is electrically and physically separate from the first and second conductors, and wherein contact surfaces at which the first conductor contacts the third conductor and at which the second conductor contacts the third conductor extend generally perpendicularly to a direction of movement of the third conductor.

2. The switch of claim 1, further comprising:

a housing configured to enclose at least the third conductor and the retaining member, wherein the retaining member is supported by the housing.

3. The switch of claim 1, wherein the retaining member at least partially comprises plastic.

4. The switch of claim 1, wherein the retaining member is configured to shear upon actuation of the pyrotechnic actuator to allow the movement of the third conductor.

5. The switch of claim 4, wherein the retaining member comprises:

a supporting element configured to retain the third conductor portion against the first and second conductor portions prior to actuation of the pyrotechnic actuator; and a shearable portion configured to shear around the supporting element upon actuation of the pyrotechnic actuator to allow the movement of the third conductor.

6. The switch of claim 5, wherein the supporting element comprises:

a threaded portion; and a threaded element configured to engage with the threaded portion, the threaded element configured to retain the third conductor portion against the first and second conductor portions prior to actuation of the pyrotechnic actuator.

7. The switch of claim 1, wherein the retaining member is configured to exert a force in a direction substantially opposite to a direction of movement of the third conductor to retain the third conductor.

8. The switch of claim 1, further comprising:

a piston arranged between the third conductor and the pyrotechnic actuator, the piston comprising a void which at least partially defines the ignition chamber.

9. The switch of claim 1, further comprising:

arc extinguishing media configured to be disposed between the first and second conductors when the third conductor is in the second position.

10. The switch of claim 1, wherein the retaining member and the pyrotechnic actuator are arranged on opposite sides of the third conductor.

11. A system, comprising:

the switch of claim 1; and a controller configured to provide a signal to the pyrotechnic actuator to ignite the pyrotechnic actuator.

12. A vehicle, comprising:

the switch of claim 1.

13. A method for operating a switch, comprising:

igniting a pyrotechnic actuator to release gas into an ignition chamber;

exerting, in dependence on the released gas, pressure on a third, moveable conductor retained in a first position by a breakable retaining member, in which first position the third conductor is arranged between, and in electrical and physical contact with, first and second conductors to define a current conduction path, contact surfaces at which the first conductor contacts the third conductor and at which the second conductor contacts the third conductor extending generally perpendicularly to a direction of movement of the third conductor;

breaking the retaining member;

displacing the third conductor from the first position to a second position by the exerted pressure, in which second position the third conductor is electrically and physically separate from the first and second conductors; and opening a current conduction path of the conductor by the displacement of the third conductor.

14. The method of claim 13, wherein breaking the retaining member comprises shearing the retaining member.

15. The vehicle of claim 12, wherein the vehicle comprises an electric vehicle.

16. A vehicle, comprising:

the system of claim 12.

17. The vehicle of claim 16, wherein the vehicle comprises an electric vehicle.

* * * * *